United States Patent [19]

Rohner et al.

[11] Patent Number: 4,610,133

[45] Date of Patent: Sep. 9, 1986

[54] MAKE-READY DEVICE FOR READYING A THREAD END

[75] Inventors: Joachim Rohner; Reinhard Mauries; Heinz Zumfeld, all of Monchen-Gladbach, Fed. Rep. of Germany

[73] Assignee: W. Schlafhorst & Co., Monchen-Gladbach, Fed. Rep. of Germany

[21] Appl. No.: 674,010

[22] Filed: Nov. 23, 1984

[30] Foreign Application Priority Data

Nov. 23, 1983 [DE] Fed. Rep. of Germany ..... 3342283

[51] Int. Cl.[4] ..... D01H 15/00

[52] U.S. Cl. ..... 57/22

[58] Field of Search ..... 57/22, 23, 261, 263

[56] References Cited

U.S. PATENT DOCUMENTS 4,408,442 10/1983 Rohner ..... 57/22

4,439,978 4/1984 Mima ..... 57/261 X 4,476,671 10/1984 Rohner et al. ..... 57/22 X 4,492,076 1/1985 Romic et al. ..... 57/22

4,528,808 7/1985 Luz ..... 57/22

*Primary Examiner*—Donald Watkins

*Attorney, Agent, or Firm*—Herbert L. Lerner; Laurence A. Greenberg

[57] ABSTRACT

A make-ready device for making a thread end ready preparatory to tying it to another thread end in a thread tying device, the make-ready device including s hollow body open at opposite ends thereof and traversible by a gas flow for receiving the thread end therein so as to at least partly stretch and parallelize the fibers of the thread end and cleanse them of short fibers, as well as for retaining the thread end therein, the gas flow being generated by an injected pressurized gas current, and pneumatically operative means conducting the injector gas for guiding the thread end in a central region of the inner hollow space of the hollow body.

2 Claims, 4 Drawing Figures

FIG. 1
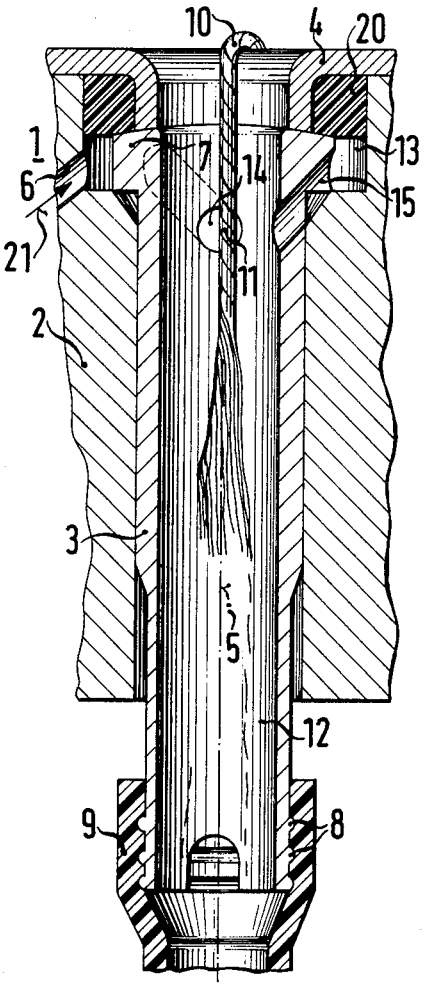
FIG. 2
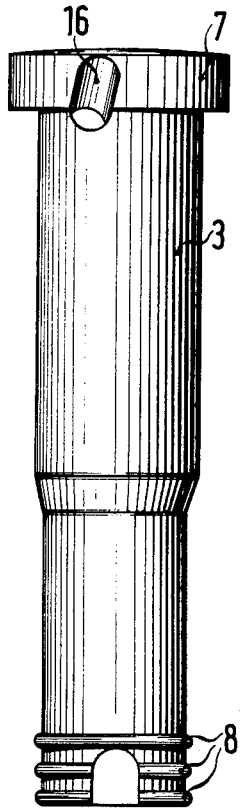
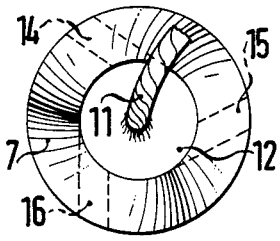
FIG. 3
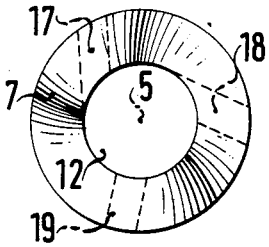
FIG. 4

MAKE-READY DEVICE FOR READYING A THREAD END

The invention relates to a make-ready device for making a thread ready, more particularly, preparatory to tying it to another thread end in a thread tying device, the make-ready device including a hollow body open at opposite ends thereof and traversible by a gas flow for receiving the thread end therein so as to at least partly stretch and parallelize the fibers of the thread end and cleanse them of short fibers, as well as for retaining the thread end therein, the gas flow being generated by an injected pressurized gas current.

If two thread ends are to be tied or connected to one another, for example, by splicing, it is necessary, in specific cases, to at least partly stretch and parallelize the fibers of the thread ends and cleanse them of short fibers beforehand. The threads generally have a thread twist which must be removed in vicinity of the ends thereof so that the individual fibers lie as parallel as possible to one another in the most stretched condition thereof. Such readied thread ends can then be tied to one another, for example, by splicing, wherein the individual fibers of both thread ends are mutually intermixed and hooked together, wound around one another and finally also mutually intertwined by a reintroduced thread twist.

It has become known heretofore to achieve stretching and parallelizing of the fibers by an air current or by a pressurized or compressed air flow. The hollow body receiving the thread end can, in this regard, have a pressurized gas guiding device in the form of a ring channel. By means of a bore, a pressurized air flow can be conducted into the inner hollow space of the hollow body, and then excite an air current in the hollow body which may be so strong that it sucks-in a thread end and holds it fast.

A disadvantage of the heretofore known construction is that the thread end is deflected towards the wall defining the inner hollow space, so that the aforementioned making-ready of the thread end suffers thereby.

It is accordingly an object of the invention to provide a make-ready device of the foregoing general type which avoids the disadvantages of the heretofore known construction and which makes a thread end ready in the most optimally briefest time satisfactory for a subsequent thread tying operation.

With the foregoing and other objects in view, there is provided in accordance with the invention, a make-ready device for making a thread end ready preparatory to tying it to another thread end in a thread tying device, the make-ready device including s hollow body open at opposite ends thereof and traversible by a gas flow for receiving the thread end therein so as to at least partly stretch and parallelize the fibers of the thread end and cleanse them of short fibers, as well as for retaining the thread end therein, the gas flow being generated by an injected pressurized gas current, comprising pneumatically operative means conducting the injector gas for guiding the thread end in a central region of the inner hollow space of the hollow body.

In accordance with another feature of the invention, the hollow body has a pressurized-gas guiding device formed as a ring channel surrounding the hollow body, and downwardly inclined passageways leading in different directions fror the ring channel into the inner hollow space.

In accordance with a further feature of the invention, at least one of the passageways extends tangentially to and terminates in the inner hollow space.

In accordance with a concomittant feature of the invention, at least one of the passageways is directed towards the central axis of the inner hollow space.

The advantages attained with the invention of the instant application are especially that a very rapid and effective readying of the thread end is achieved due to the special guidance of the injector air which prevents any adhesion of the thread end or individual parts thereof to the inner wall defining the hollow space, and simultaneously holds the thread end in continuous motion. By tangentially guiding the injector flow, a screw-type gas flow is produced which has either a right-hand or left-hand twist depending upon the respective direction of the tangential flow. This is utilized for more rapid loosening or untwisting of right-hand twisted or left-hand twisted threads. The direction of the tangential flow is set so that the resultant twist of the air flow has a loosening or untwisting effect upon the thread end. On the other hand, it is advantageous for specific threads to conduct or guide at least one injector gas jet towards the longitudinal axis of the hollow space whereat this gas or air jet directly impinges on the thread end which is disposed or guided along that axis.

Other features which are considered as characteristic for the invention are set forth in the appended claims.

Although the invention is illustrated and described herein as embodied in a make-ready device for readying a thread end, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a longitudinal sectional view of a make-ready device for making a thread end ready for the purpose of tying it to another thread end in a thread tying device;

FIG. 2 is a side elevational view of a hollow body forming part of the make-ready device of FIG. 1;

FIG. 3 is a top plan or end view of FIG. 3; and

FIG. 4 is a view like that of FIG. 3 of another embodiment of the hollow body wherein passageways or break-throughs therein are disposed at different locations from those in the embodiment of FIG. 3.

Referring now to the drawing and first, particularly, to FIG. 1 thereof, there is shown a make-ready device for readying a thread end preparatory to tying it to another thread end, in accordance with the invention, which has a base member 2 wherein a tubular shaped hollow body 3 is mounted in such a manner that, after removal of an inlet funnel 4 therefrom, the hollow body 3 can be rotated about the longitudinal axis 5 thereof and also withdrawn from the base member 2 and exchanged for a different hollow body. The base member 2 has a pressurized gas feed line 6 in the form of a bore which can be connected to a controllable non-illustrated pressurized gas source.

The hollow body 3 is open at both ends thereof and is provided with a flange-type widened or beefed-up part 7 at the thread inlet thereof. The other end i.e. the lower end, as viewed in FIG. 1, of the hollow body 3 has a smaller outer diameter than the upper or thread inlet end thereof and is formed with beads 8 which serve to hold a hoseline 9.

The hollow body 3 has pneumatically operative means conducting injector gas flowing in through the pressurized gas feed line 6 for guiding a thread end 11 of a thread 10 in the central region of the inner hollow space 12 of the hollow body 3. These pneumatically effective means are made up of a pressurized gas guiding device in the form of a ring channel 13 surrounding the hollow body 3 at the level of the flange-type beefed-up part 7 thereof, in connection with passageways or break-throughs 14, 15 and 16 leading in different directions from the ring channel 13 downwardly inclined into the inner hollow space 12.

As is shown especially in FIG. 3, the three passageways 14, 15 and 16 are disposed uniformly distributed over the periphery of the hollow body 3, and terminate tangentially in the inner hollow space 12. The ring channel 13 is formed by a beefed-up part of the base member 2 and is sealed by a sealing ring 20 from the outside and from the inlet funnel 4.

The instant pressurized gas flows into the ring channel 13 in direction of the arrow 21, three injector air currents directed tangentially downwardly into the hollow space 12 produce therein an air current directed downwardly from above which take a corkscrew-type course. This air current is capable of sucking in the thread end 11 of the S-twisted thread 10 and guiding it for the purpose of making it ready in the central region of the inner hollow space 12. Because the air current is directed opposite to the thread twist, the thread twist rapidly loosens and untwists, the fibers thereof are rapidly separated or isolated and the short fibers thereof are rapidly removed.

In the different embodiment shown in FIG. 4, the passageways or break-throughs 17 and 18 have a left-hand turn tangentially into the hollow space 12. This embodiment is therefore better suited for Z-twisted yarn or thread. The break-through or passageway 19 is directed towards the central or longitudinal axis, respectively, of the inner hollow space 12. To loosen the thread end of a thread of special structure, this can be advantageous. When threads are difficult to handle, it can in fact, be advantageous to direct all of the break-throughs or passageways towards the longitudinal axis.

We claim:

1. Make-ready device for making a thread end ready preparatory to tying it to another thread end in a thread tying device, the make-ready device including a hollow body open at opposite ends thereof and traversible by a gas flow for receiving the thread end therein so as to at least partly stretch and parallelize the fibers of the thread end and cleanse them of short fibers, as well as for retaining the thread end therein, the gas flow being generated by an injected pressurized gas current, comprising pneumatically operative means conducting the injector gas for guiding the thread end in a central region of the inner hollow space of the hollow body, a pressurized-gas guiding device formed as a ring channel surrounding the hollow body, and downwardly inclined passageways lead in different directions form the ring channel into the inner hollow space, at least one of said passageways extending tangentially to and terminating in said inner hollow space.

2. Make-ready device according to claim 1, wherein at least one of said passageways is directed towards the central axis of said inner hollow space.

* * * * *